US007264210B2

(12) United States Patent
Yu

(10) Patent No.: US 7,264,210 B2
(45) Date of Patent: Sep. 4, 2007

(54) PORTABLE UMBRELLA STAND

(75) Inventor: Fengming Yu, Taizhou Zheijang (CN)

(73) Assignee: Jim Utterback, Santa Ana, CA (US)

( * ) Notice: Subject to any disclaimer, the term of this patent is extended or adjusted under 35 U.S.C. 154(b) by 83 days.

(21) Appl. No.: 10/983,303

(22) Filed: Nov. 8, 2004

(65) Prior Publication Data

US 2006/0097117 A1 May 11, 2006

(51) Int. Cl.
*A45F 3/44* (2006.01)

(52) U.S. Cl. ..... 248/156; 135/16; 248/530

(58) Field of Classification Search ..... 248/545, 248/156, 530, 532, 507; 135/16; 52/157, 52/165, 161
See application file for complete search history.

(56) References Cited

U.S. PATENT DOCUMENTS

| | | | | |
|---|---|---|---|---|
| 4,832,304 | A | 5/1989 | Margolis | |
| 4,938,446 | A | 7/1990 | Williams | |
| 5,482,246 | A * | 1/1996 | Derkoski | 248/530 |
| 5,535,978 | A | 7/1996 | Rodriguez et al. | |
| 6,032,880 | A * | 3/2000 | Verrills et al. | 248/530 |
| 6,116,556 | A * | 9/2000 | Roth | 248/218.4 |
| 6,199,569 | B1 * | 3/2001 | Gibson | 135/16 |
| 6,338,465 | B1 | 1/2002 | Stoner | |
| 6,443,172 | B2 | 9/2002 | Brumfeld | |
| 6,732,985 | B1 | 5/2004 | Cantrell | |
| 6,820,379 | B1 * | 11/2004 | Krinner et al. | 52/157 |
| 7,007,910 | B1 * | 3/2006 | Krinner et al. | 248/530 |
| 2001/0017150 | A1 | 8/2001 | Doreste | |
| 2001/0035201 | A1 | 11/2001 | Kuzmic | |
| 2001/0048060 | A1 | 12/2001 | Brumfeld | |
| 2003/0205647 | A1 * | 11/2003 | Boucher | 248/156 |
| 2004/0065802 | A1 | 4/2004 | Clasen | |
| 2004/0169121 | A1 | 9/2004 | Winn | |
| 2005/0116133 | A1 * | 6/2005 | Patsalaridis | 248/530 |

FOREIGN PATENT DOCUMENTS

GB 2092638 A * 8/1982

* cited by examiner

*Primary Examiner*—Ramon O Ramirez
(74) *Attorney, Agent, or Firm*—Plager Law Offices, P.C.; Jeffrey A. Travis, Esq.

(57) ABSTRACT

An umbrella stand having a tube with an axial lumen, a top, a bottom, and the top capable of receiving a pole into the axial lumen; a removable lever; the top being able to receive and release the removable lever; and the bottom capable of securing the tube into the ground. Or, the above device wherein a first hole and a second hole are oppositely positioned on the side of the tube; and the removable lever comprises a cylindrical rod capable of fitting through the first and second hole. Or, the above device wherein the a grip screw is coupled to the side of the tube and capable of securing the pole in the tube; an annular shim is placed in the stand; the bottom of the stand is a grooved spiral; and latches are coupled to the stand and capable of holding the removable lever.

4 Claims, 4 Drawing Sheets

PORTABLE UMBRELLA STAND

BACKGROUND OF THE INVENTION

1. Field of the Invention

The present invention relates to the field of pole stands. More specifically, the present invention relates to umbrella stands that allow umbrellas and even flags, signs, and any other standard poles that need to be anchored into the ground, sand, or any other penetrable surface.

2. Description of the Related Art

Beach Umbrellas are becoming necessary accessories at beaches, parks, and other places where the effects of the sun can severely burn both young and old. However, Umbrellas and the like are often difficult to make stand in soft ground or sand, or against winds that easily pull them down once they are set up. Furthermore, finding ways to anchor these stands onto the ground easy for both strong and weak has been difficult since ensuring they are properly grounded requires some strength.

Umbrella stands come in several types with those most relevant for this application being surface or sub-surface stands that either weight or anchor the pole on or in the ground.

Surface pole stands usually comprise a weighted apparatus with a means for holding a standard pole. (See U.S. Pat. No. 4,148,455 to Robert J. Oliver; U.S. Pat. No. 5,207,406 to Janice Stine and Karen Solari; or U.S. Pat. No. 6,446,930 to Jun Li) After ballast is provided in the weighted apparatus, it then rests on the ground or sand into which the pole is securely positioned.

In addition to surface there are also sub-surface stands in the class of the present invention. These types of stands use an existing landscape to leverage the stand and umbrella in the ground instead of a separate weighted ballast apparatus. The advantage of this type of stand is obvious in that one does not have to carry a large—even if empty—apparatus used for ballasting the umbrella in its stand to the beach.

The other option are sub-surface stands, which are common for use in many different types of activities such as fishing, (See, U.S. Pat. No. 4,938,446 to James Williams or U.S. Pat. No. 6,338,465 to Freddie Stoner) multi-purpose activities, (See, U.S. Pat. No. 6,732,985 to Douglas Cantrell) flags, (See, pending U.S. application 2004/0169121 A1 to Anthony Winn) and, of course, umbrellas. (See. U.S. Pat. No. 6,443,172 and Application 2001/0048060 to Donald Brumfeld, U.S. Pat. No. 5,535,978 to Arturo Rodriguez, or U.S. Pat. No. 4,832,304 to Alexander Margolis).

How sub-surface stands are anchored into the ground. Most either requires a downward force directed onto the umbrella stand or require a person to step onto a plane attached to the stand forcing the stand into the ground. One invention, similar to the present invention, has a folding clamp permanently coupled to the pole stand that clamps around the pole in its clamped position and when unfolded, creates a horizontal lever allowing someone to turn the lever and screw the pole into the ground. (U.S. application 2004/0169121 A1 to Anthony Winn) However, there are a few problems with the Winn stand. The first is that if the stand needs to be placed on an inclined angle, the extended clamp is fixed and it can be difficult and most times impossible to screw the stand into the ground because the handle portion of the clamp will be wedged against the side of the incline. Second, because poles come in various shapes and sizes, the Winn stand clamps only around poles of a definite diameter. If a pole is too large, as many wooden poles are, the clamp will not fit around it.

Lastly, umbrella stands are impulse items that normally cost under $20. They should be inexpensive to manufacture; effective in their purpose; light and easy to use; durable; avoid the use of complicated mechanisms easily ruined by sand and other natural elements; and portable. In devices such as this, the fewer components the better so that the overall item costs less and because the nature of these devices are such that they are in and around sand, water, and other natural elements that easily corrode and destroy. The Winn stand does not avoid these problems.

None of the above-mentioned references—save the present invention—achieves all of the preceding criteria.

SUMMARY OF THE INVENTION

The object of the present invention is to provide a device for securing an umbrella in the ground, the device comprising a tube with an axial lumen, a top, a bottom, and the top capable of receiving a pole into the axial lumen; a removable lever; the top comprising means for receiving and removing the removable lever; and the bottom comprising means for securing the tube into the ground. It is a further object of the present invention to provide a device for securing an umbrella wherein the means for receiving and detaching the removable lever comprises two holes oppositely positioned on the side of the tube; and an elongated, cylindrical lever capable of fitting through the holes and the means for securing the tube into the ground comprises a grooved spiral.

DETAILED DESCRIPTION OF THE DRAWINGS

Figure 1:
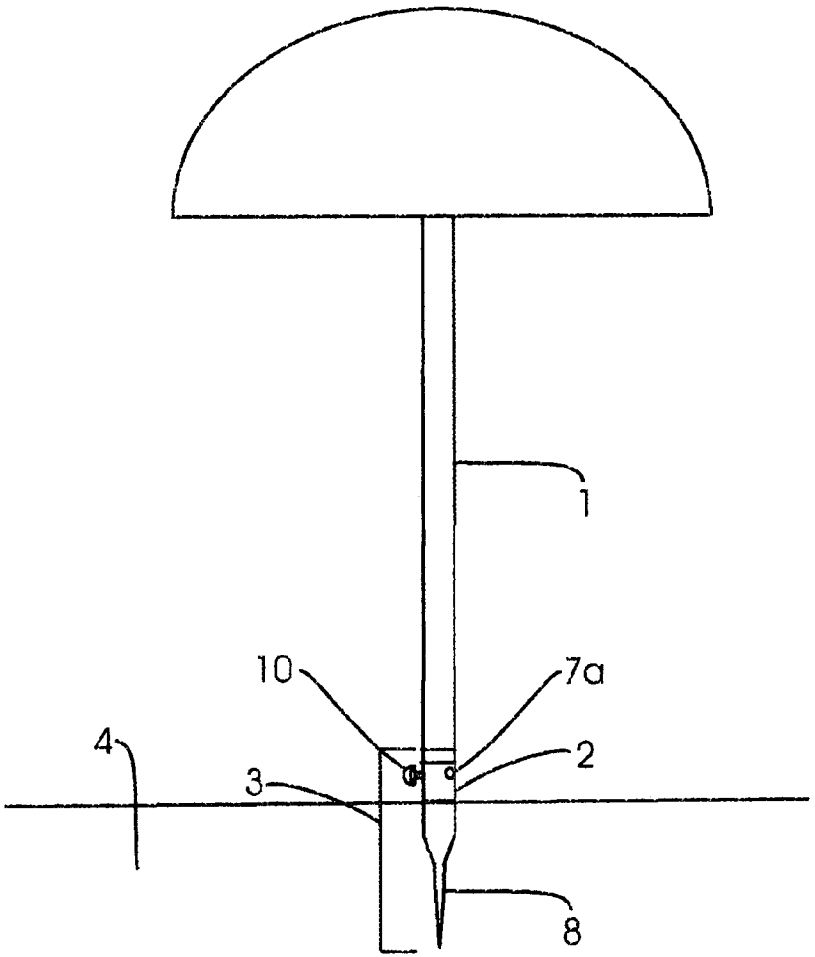
FIG. 1 Shows a functional view of the umbrella stand in the ground holding an umbrella FIG. 2 Shows perspective view of the umbrella stand with a removable crowbar and a grooved spiral bottom FIG. 3 Shows a perspective view of the umbrella stand with the removable crowbar inserted through the top of the stand FIG. 4 Shows a perspective view of the umbrella stand with a grip screw FIG. 5 Shows a side view of the umbrella stand with an inserted pole and fully threaded grip screw FIG. 6 Illustrates a perspective view of an annular shim and its position just before being inserted into the umbrella stand FIG. 7 Shows a side view of the umbrella stand with push latches

The present invention is illustrated in FIGS. 1 through (7).

The use of the present invention is illustrated in FIG. 1. Here, a standard umbrella (1) slides into the top of the stand proper of the present invention (3) and is then inserted into the stand and secured through the use of a grip screw. (10) The bottom of the stand (8)—usually a plain tapered point or a grooved spiral—is then driven into the ground (4) or other penetrable surface with the top portion of the stand (2) remaining above the ground. Although the present invention can hold umbrellas, it will become apparent to those skilled in the art that other poles for such things as flags, fishing poles, and etc. are also suitable for placement in the stand.

Figure 2:
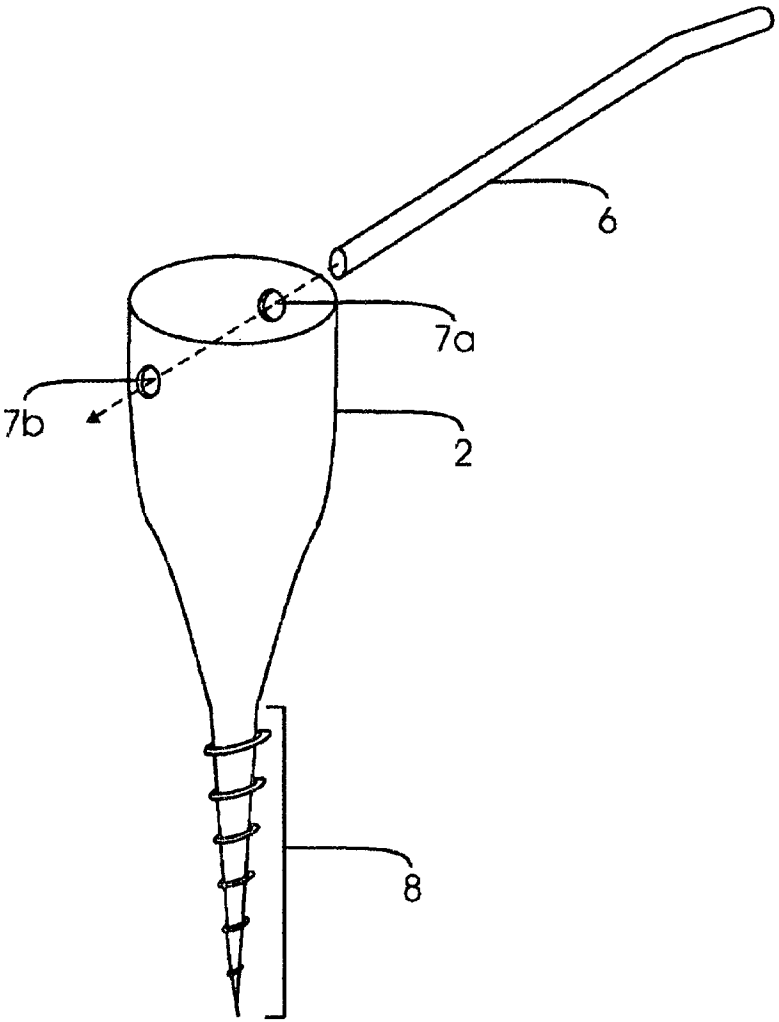

In FIG. 2, the stand is comprised of a top portion with an axial lumen (2) capable of receiving a standard umbrella pole. The stand also comprises a bottom portion (8) with an end capable of being inserted by force into the ground through a lever function by means of either a crowbar or pry bar. (6) The present invention's lever function is illustrated through the use of a crowbar or pry lever (6) that is capable of being inserted through two holes (7*a*) and (7*b*) that are oppositely positioned near the top of the stand allowing a person to slide the crowbar through the holes and twist the stand into the ground or other penetrable surface. It will be noted that there are a multitude of ways to secure the crowbar when it is used as a lever including a pawl and groove that can be pressed to release the crowbar; or a spring or pressure release bolt or pin that snaps into a groove in the crowbar when inserted through the holes.

Here, the bottom of the stand is a tapered point with a grooved spiral. (8) A tapered point with a grooved spiral is preferred, but any end that will allow someone to twist the stand into the ground through the use of the crowbar (6) will be sufficient. One example not shown here would be any ridged or jagged end capable of being twisted into the ground by the crowbar.

Figure 3:
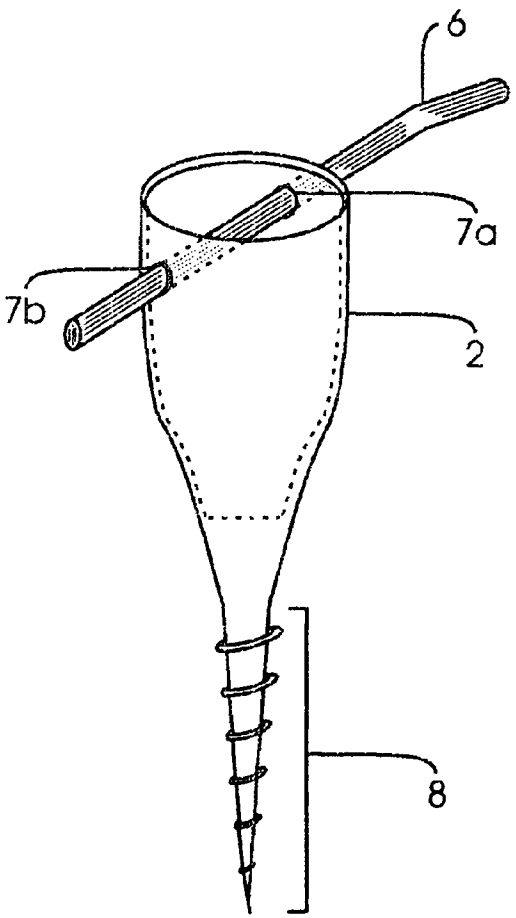

FIG. 3 illustrates a tapered point (9) that is not in the form of a grooved spiral. Further, The crowbar (6) or the holes (7*a*) and (7*b*) need not be circular or cylindrical but may comprise any shape allowing a crowbar or pry bar (6) to pass through one hole, (7*a*) through the axial lumen at the top of the stand, and through to the second hole. (7*b*) The crowbar (6) should also be long enough such that once it has passed through both holes there is enough room to grip the lever/crowbar. Here, the lever is bent at its end to provide further leverage. The crowbar may also have a gripping means by way of a handle to provide additional support. Accordingly, the top of the stand and its axial lumen (2) can be any size such that it is large enough to accommodate poles of various diameters. FIG. 3 is illustrative of a fully inserted crowbar (6) through the stand.

Figure 4:
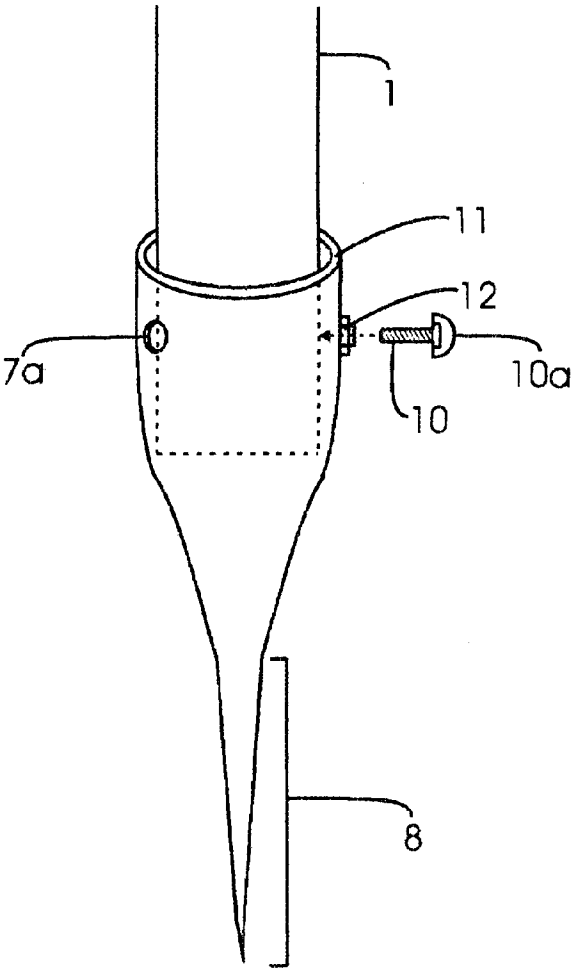

The stand in FIG. 4 shows a grip screw (10) capable of passing through the wall of the stand, (11) through a threaded hole, (12) and then through to the axial lumen of the top portion of the stand. (2) The grip screw, (10) once screwed through the threaded hole (12) and onto the inserted pole, (1) provides a means for securing the pole in the stand through the pressure of the screw (10) on the pole. Necessarily, the grip screw (10) needs to be long enough such that it can be screwed onto poles of differing diameters.

Figure 5:
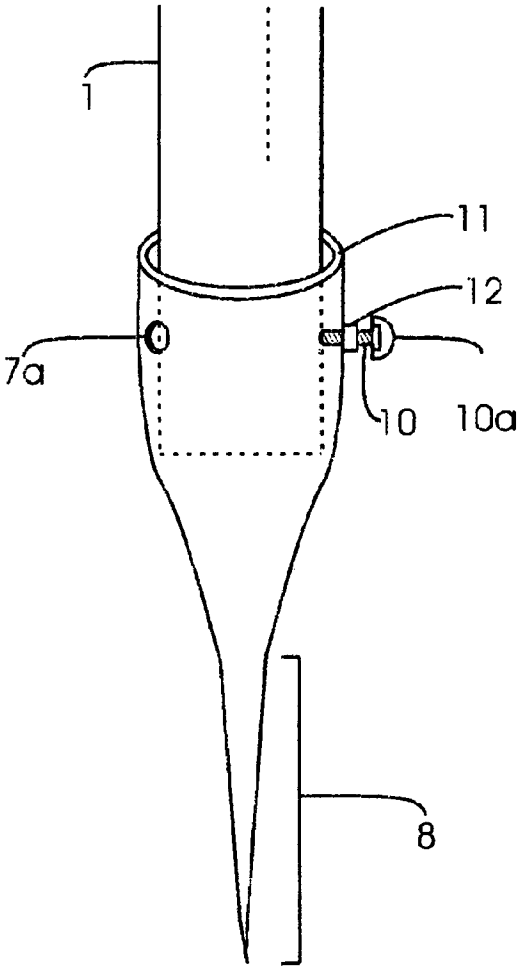

FIG. 5 shows a fully inserted and threaded grip screw (10) pressed against the pole (1) securing it in the pole stand. (2) Further, a handle (10*a*) can be coupled to the grip screw making it easier to turn.

Figure 6:
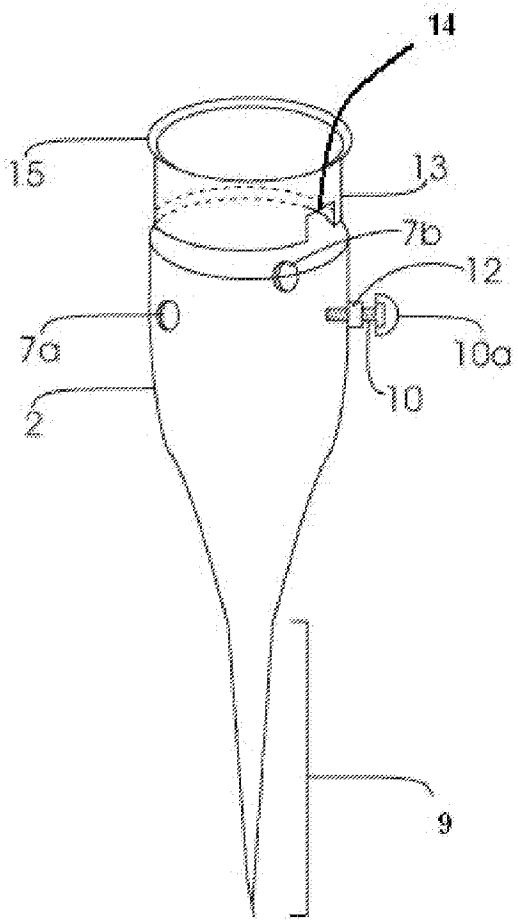

Another aspect of the invention is illustrated in FIG. 6 where a shim (13) can be inserted into the axial lumen of the top of the stand (2) so as to provide additional support for the pole in addition to the grip screw. (10) A plastic shim prevents the metal from an inserted pole from contacting the wall of the stand thereby further preventing rust. The shim (13) has a bottom portion that is inserted into the axial lumen of the stand and a top portion that normally rests flush with the stand. However, it may also have a slightly protruding lip (15) around the circumference of the top of the shim to prevent it from sliding into the axial lumen. Further, in order to allow the grip screw to pass through to the hole to the inserted pole, the shim (13) may also have a slotted groove (14) such that when the shim is properly situated into the axial lumen of the stand, the screw will pass through the slotted groove and press against the inserted pole and aligned with the placement of the threaded hole.

Figure 7:
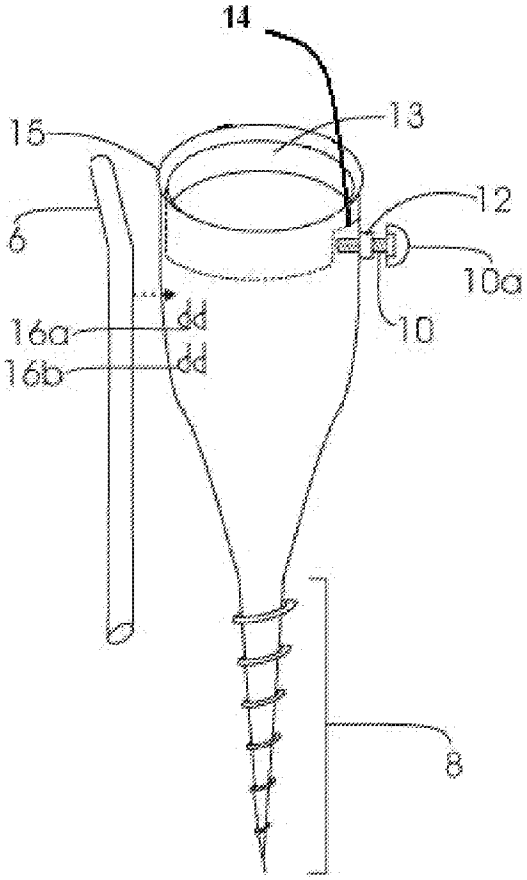

Another aspect of the invention is illustrated in FIG. 7 whereby push latches (16*a*) and (16*b*) are joined to the stand in order to secure the crowbar (6) to the stand once the stand is in the ground. (4) This particular embodiment of the present invention uses push latches where the crowbar is pushed into latches that fit around it and secure it through force of pressure. For durability, the push latches here are made of metal and welded onto the stand. However, any kind of latch, clamp, or even a screw or bolt assembly that fits through a hole in the crowbar and onto the stand may be used that allows the crowbar to easily fit onto the stand so long as they are able to accommodate its size and shape. The latches can be made from a hard plastic or a lightweight metal.

FIG. 7 also illustrates a fully inserted shim (13) into the axial lumen of the stand (2) in addition to showing the placement of the crowbar relative to the latches.

The stand proper (3) can be made of any material capable of holding a pole. However, successful materials used for the present invention have been standard gauge sheet metal, other rust proofed metal because of the stands' constant contact with water, or a hard plastic that can withstand the force of screwing or driving the stand into the ground. In another embodiment the stand can be made of a sturdy wood, preferably with a water-proof coating to protect it from natural corrosive elements.

These figures illustrate the common uses and embodiments of the present invention but do not represent its every aspect. Those skilled in the art will readily see other, obvious variations that do not deviate from its essential function and use.

The invention claimed is:

1. An umbrella stand capable of being anchored in the ground, the stand comprising:

a tube with an axial lumen, a top, a bottom, and the top capable of receiving a pole into the axial lumen;

a removable lever;

the top comprising means for receiving and removing the removable lever;

a removable, annular shim with a lip around its circumference capable of being inserted into the axial lumen at the top of the tube;

a push latch on the side of the tube capable of securing the removable lever; and the bottom comprising means for securing the tube into the ground.

2. The stand of claim 1 wherein the device is composed of metal.

3. The stand of claim 1 wherein the device is composed of plastic.

4. The stand of claim 1 further comprising:

means for receiving and removing the removable lever are two holes oppositely positioned on the side of the tube;

a threaded hole on the side of the tube penetrating through the tube to the axial lumen;

a grip bolt or screw capable of being threaded into the threaded hole; and the means for securing the tube into the ground comprising a grooved spiral.

* * * * *